US006997527B2

(12) United States Patent
Cheng

(10) Patent No.: US 6,997,527 B2
(45) Date of Patent: Feb. 14, 2006

(54) DRAWER LOCKING STRUCTURE

(75) Inventor: Chen Kung Cheng, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 0 days.

(21) Appl. No.: 10/815,810

(22) Filed: Apr. 2, 2004

(65) Prior Publication Data

US 2005/0218760 A1 Oct. 6, 2005

(51) Int. Cl.
*A47B 88/00* (2006.01)

(52) U.S. Cl. ..... 312/332.1; 312/333

(58) Field of Classification Search ..... 312/332.1, 312/333, 334.44, 334.46, 334.47; 384/21
See application file for complete search history.

(56) References Cited

U.S. PATENT DOCUMENTS

| | | | | |
|---|---|---|---|---|
| 3,239,298 | A * | 3/1966 | McCarthy | 312/333 |
| 3,782,800 | A * | 1/1974 | Remington et al. | 312/333 |
| 4,191,436 | A * | 3/1980 | Cherry | 312/334.11 |
| 4,423,914 | A * | 1/1984 | Vander Ley | 312/333 |
| 5,292,191 | A * | 3/1994 | Slivon | 312/332.1 |
| 5,388,902 | A * | 2/1995 | Huebschen et al. | 312/332 |
| 5,823,649 | A * | 10/1998 | Hinrichs | 312/334.45 |
| 5,868,478 | A * | 2/1999 | Yemini | 312/332.1 |
| 6,250,730 | B1 * | 6/2001 | Roth et al. | 312/333 |
| 6,431,615 | B1 * | 8/2002 | Bastian | 312/332.1 |
| 6,527,353 | B1 * | 3/2003 | Bradfish et al. | 312/332.1 |

FOREIGN PATENT DOCUMENTS

| | | | |
|---|---|---|---|
| GB | 2216780 | * 10/1989 | 312/333 |

* cited by examiner

*Primary Examiner*—Lanna Mai
*Assistant Examiner*—Hanh V. Tran
(74) *Attorney, Agent, or Firm*—Troxell Law Office, PLLC

(57) ABSTRACT

A drawer locking structure including a cabinet body, a drawer disposed inside the cabinet body and a lock device. The lock device includes a shift body, a stopper body and a resilient body. The shift body has a driving section and a force application section. The shift body is pivotally connected with the front board of the drawer. The stopper body is disposed on outer side of the drawer. The resilient body includes a first connecting section and an engaging section. Via the first connecting section, the resilient body is disposed on inner side of the cabinet body corresponding to the stopper body. When the drawer is positioned in the cabinet body, the engaging section is engaged with the stopper body, whereby the drawer is prevented from slipping outward due to inclination or movement of the cabinet body. When it is desired to draw out the drawer, a pulling force can be applied to the force application section. At this time, the driving section is driven to press down and deform the resilient body. Under such circumstance, the stopper body is disengaged from the engaging section to release the drawer, permitting the drawer to be drawn out.

6 Claims, 7 Drawing Sheets

DRAWER LOCKING STRUCTURE

BACKGROUND OF THE INVENTION

The present invention is related to a locking structure between two relatively slidable articles, and more particularly to a drawer locking structure for preventing a drawer of a file cabinet or tool cabinet from slipping out.

A conventional file cabinet or tool cabinet is a substantially rectangular solid box body composed of several panels. The file cabinet or tool cabinet has a front opening in which several drawers are sequentially arranged from upper side to lower side. Papers or tools can be placed in the drawers. In order to easily pull/push the drawers, ball bearings with several balls are disposed on the cabinet body and the drawers for easily pulling/pushing the drawers and reducing noise.

In the case that the file cabinet or tool cabinet is placed on an inclined ground or when the file cabinet or tool cabinet is moved, it often takes place that the drawers slip out from the cabinet body or even drop down. This is inconvenient and dangerous.

SUMMARY OF THE INVENTION

It is therefore a primary object of the present invention to provide a drawer locking structure for preventing a drawer of a file cabinet or tool cabinet from unexpectedly slipping out when the cabinet body is inclined or moved. The drawer can be readily drawn out as desired.

According to the above object, the drawer locking structure includes a cabinet body, a drawer disposed inside the cabinet body and a lock device. The lock device includes a shift body, a stopper body and a resilient body. The shift body has a driving section and a force application section. The resilient body includes an engaging section for engaging with the stopper body.

The present invention can be best understood through the following description and accompanying drawings wherein:

DETAILED DESCRIPTION OF THE PREFERRED EMBODIMENTS

Figure 1:
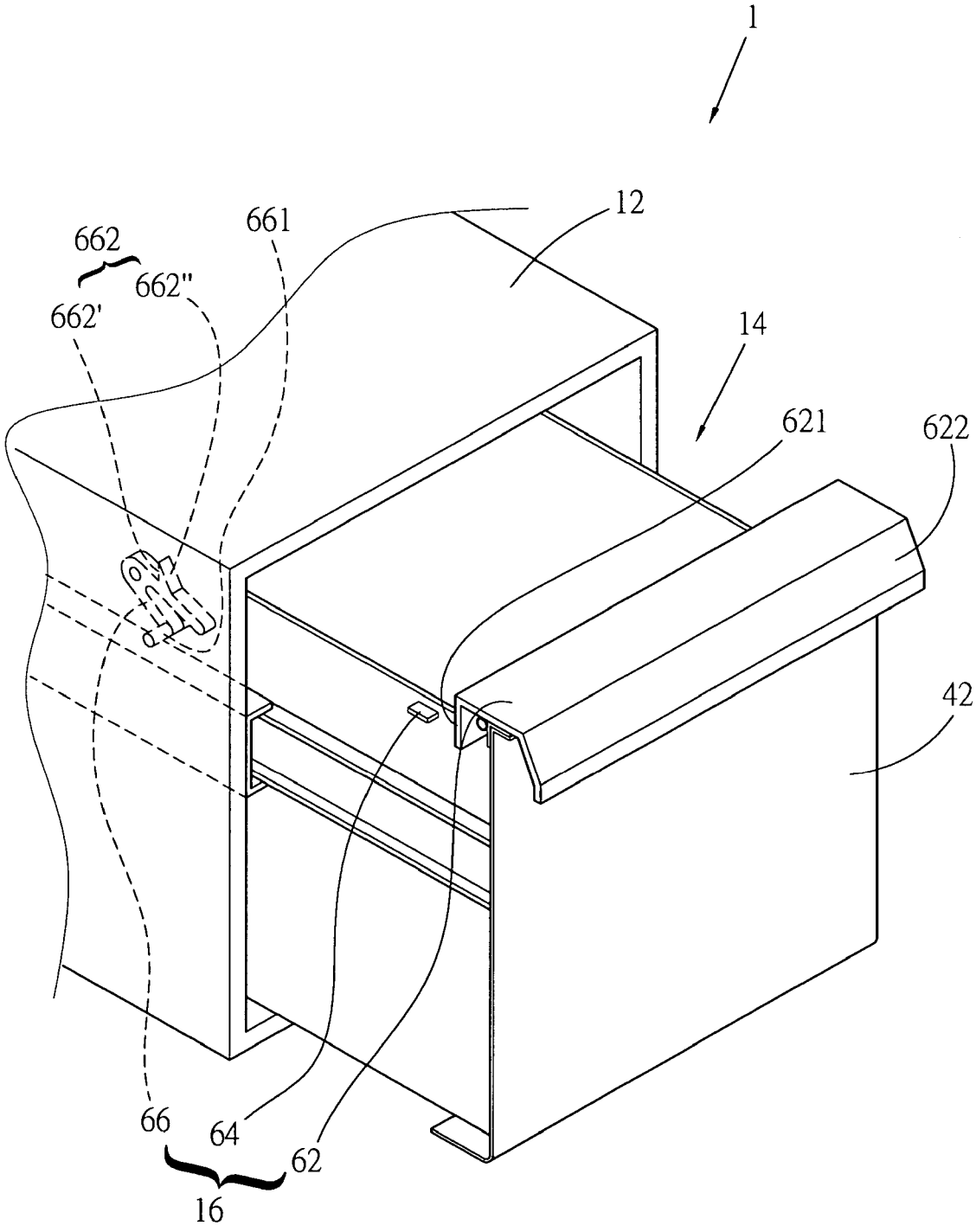
FIG. 1 is a perspective view of a first embodiment of the present invention.

Please refer to FIGS. 1, 2A, 2B, 2C, 2D and 2E. The drawer locking structure 1 of the present invention includes a cabinet body 12, a drawer 14 disposed inside the cabinet body 12 and a lock device 16.

The cabinet body 12 is a rectangular solid body composed of a rear board, two sideboards, an upper board and a lower board. The cabinet body 12 has a front opening.

The drawer 14 is a rectangular solid body composed of a front board, a rear board, two sideboards and a lower board.

The drawer 14 has an upper opening. The drawer 14 is back and forth and inward and outward slidably disposed in the cabinet body 12.

The lock device 16 includes a shift body 62, a stopper body 64 and a resilient body 66.

One end of the shift body 62 is formed with a driving section 621. The other end of the shift body 62 has a force application section 622. A middle portion of the shift body 62 is pivotally connected with the front board 42 of the drawer 14, whereby the driving section 621 and the force application section 622 are respectively positioned on inner and outer sides of the front board 42. When a force is applied to the force application section 622, the driving section 621 is displaced relative to the front board 42 of the drawer 14.

The stopper body 64 is a lug projecting from outer side of one sideboard of the drawer 14.

The resilient body 66 includes a first connecting section 661 and an engaging section 662. Via the first connecting section 661, the resilient body 66 is disposed on inner side of one sideboard of the cabinet body 12 corresponding to the stopper body 64. The engaging section 662 of the resilient body 66 serves to engage with the stopper body 64. The engaging section 662 has a stop face 662' and a guide slope 662".

Figure 2A:
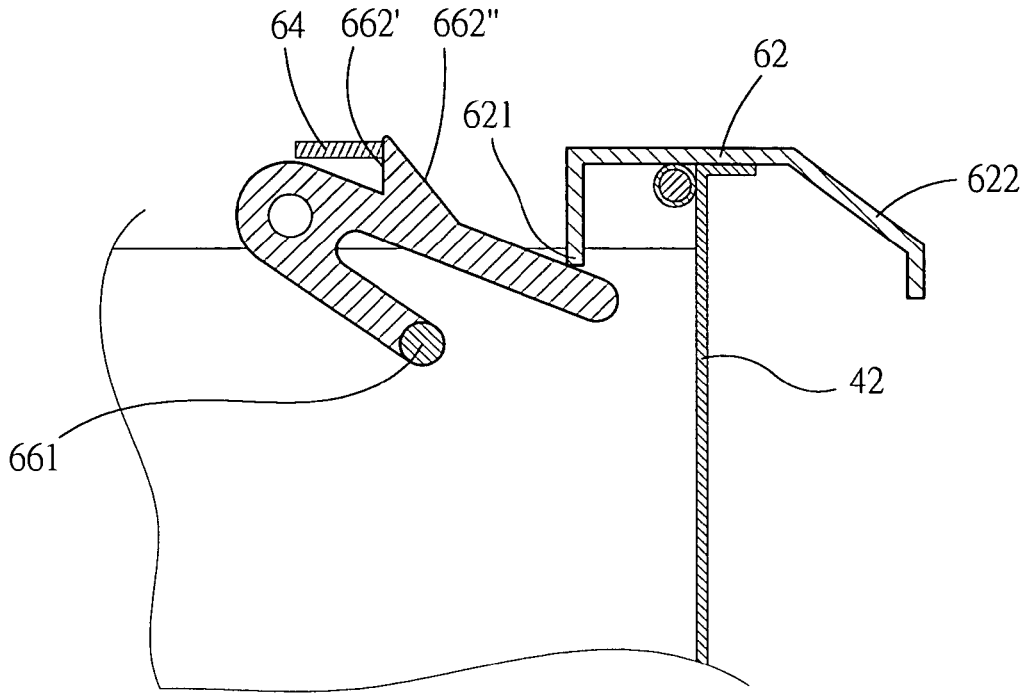
FIGS. 2A, 2B, 2C, 2D and 2E are side views showing the operation of the first embodiment of the present invention.
Figure 2B:
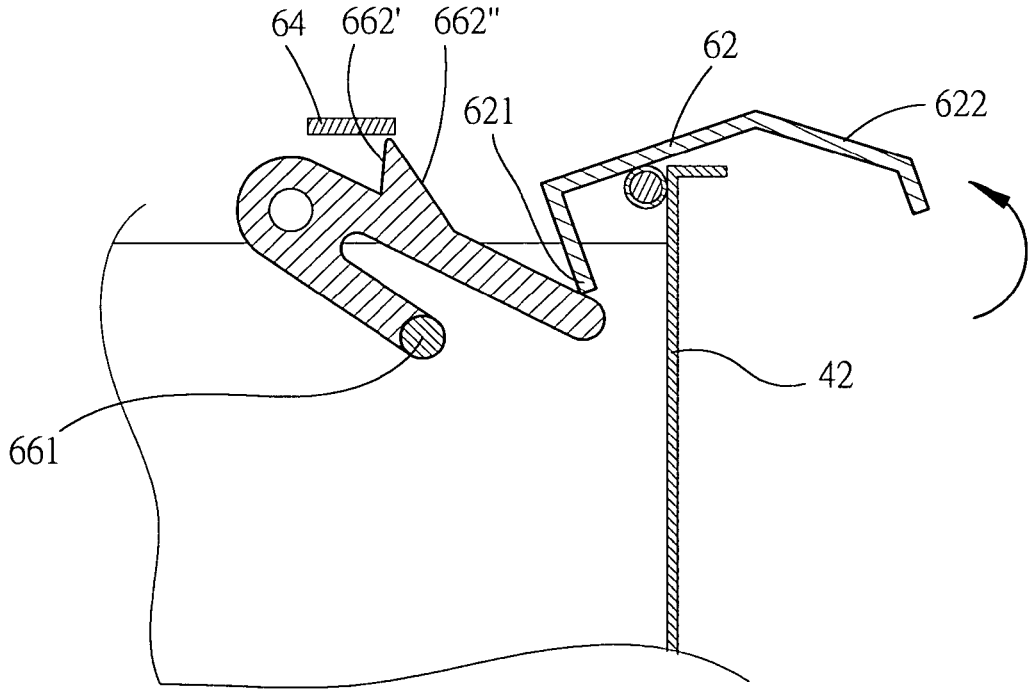
Figure 2C:
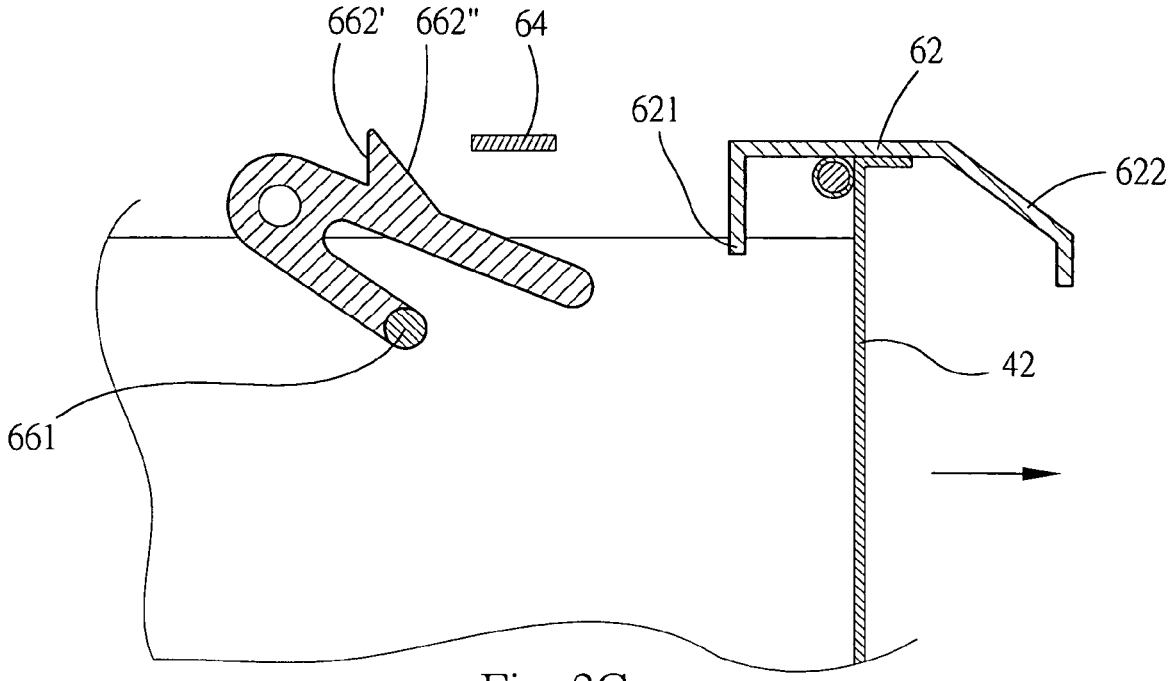
Figure 2D:
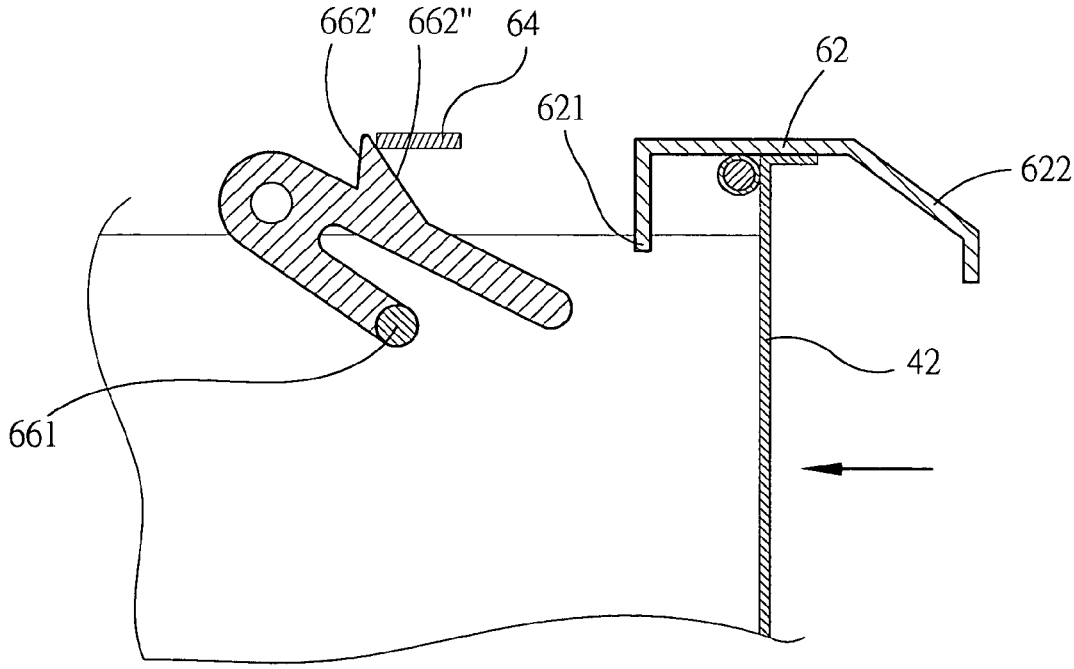
Figure 2E:
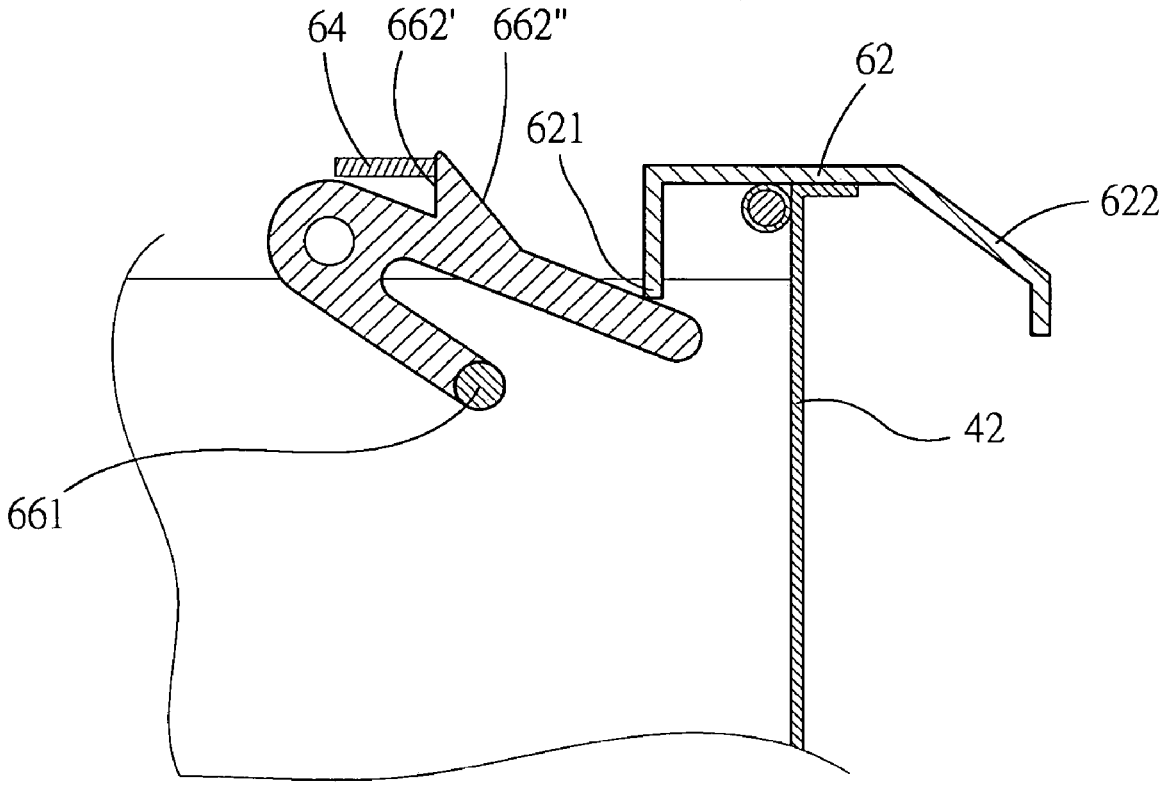

According to the above structure, when the drawer 14 is positioned in the cabinet body 12 (as shown in FIG. 2A), a pulling force can be applied to the force application section 622. At this time, the driving section 621 is driven to press down and deform the resilient body 66. Under such circumstance, the highest point of the engaging section 662 is lower than lower side of the stopper body 64 to form a released state (as shown in FIG. 2B). Therefore, the drawer 14 is disengaged from the cabinet body 12 and can be pulled outward. When the drawer 14 is pushed into the cabinet body 12, the stopper body 64 moves along the guide slope 662" of the engaging section 662 to press down the resilient body. At this time, the stopper body 64 passes through the guide slope 662" of the resilient body 66, whereby the resilient body 66 is restored to its home position and the stop face 662' abuts against the stopper body 64 to stop the drawer 14. Therefore, the drawer 14 is prevented from slipping outward when the cabinet body 12 is inclined or moved.

The drawer locking structure 1 of the present invention has the following advantage:

The shift body 62 is positioned on upper edge of the front board of the drawer 14. A user can naturally exert a force onto the force application section 622 of the shift body 62 to make the driving section 621 press down the resilient body 66 and disengage the drawer 14 from the cabinet body 12. When the cabinet body 12 is inclined or moved, the drawer 14 is prevented from slipping out of the cabinet body 12 so as to avoid inconvenience or danger.

Figure 3:
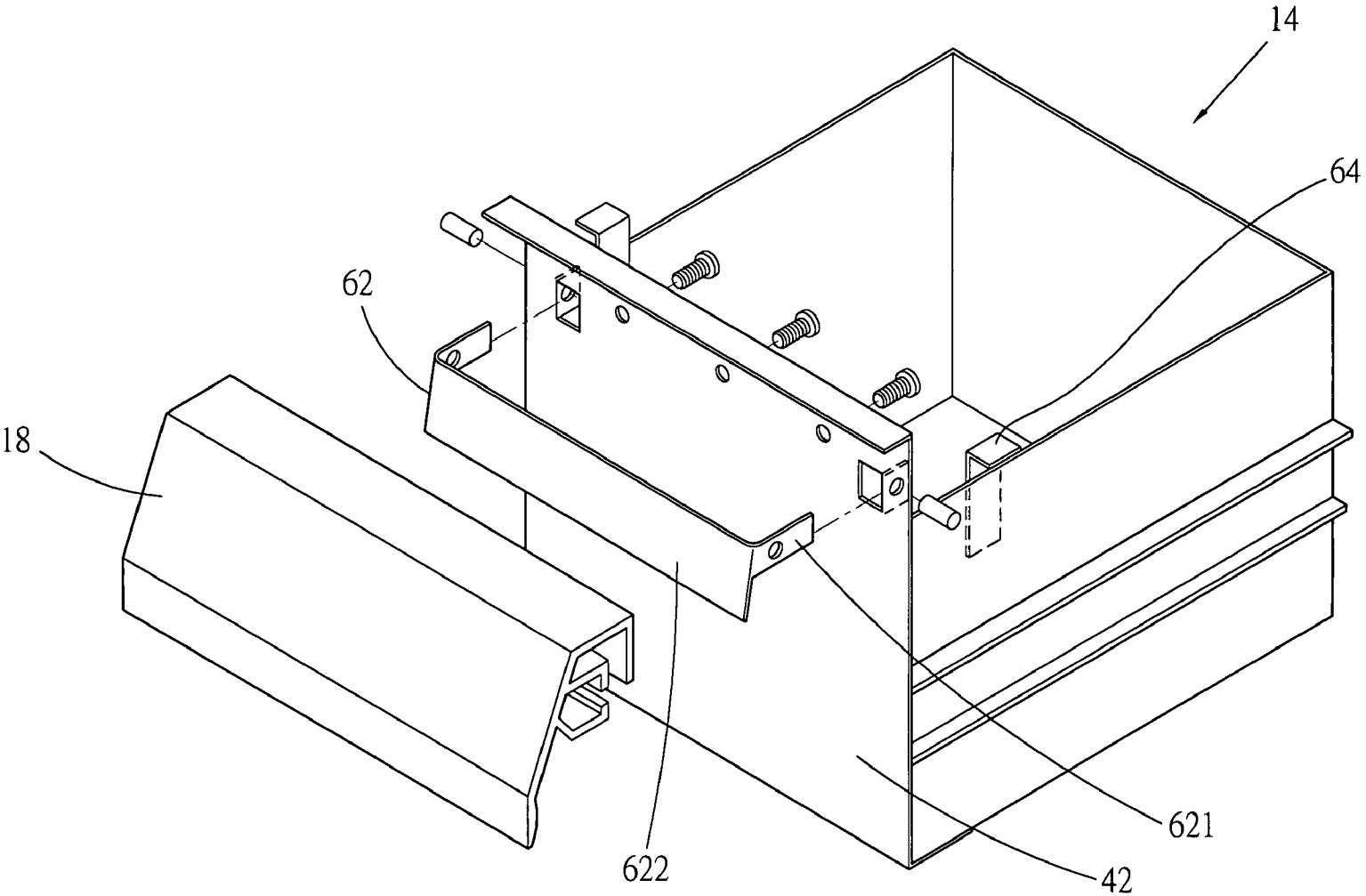
FIG. 3 is a perspective exploded view of a second embodiment of the present invention, in which the cabinet body and the resilient body are removed.
Figure 4A:
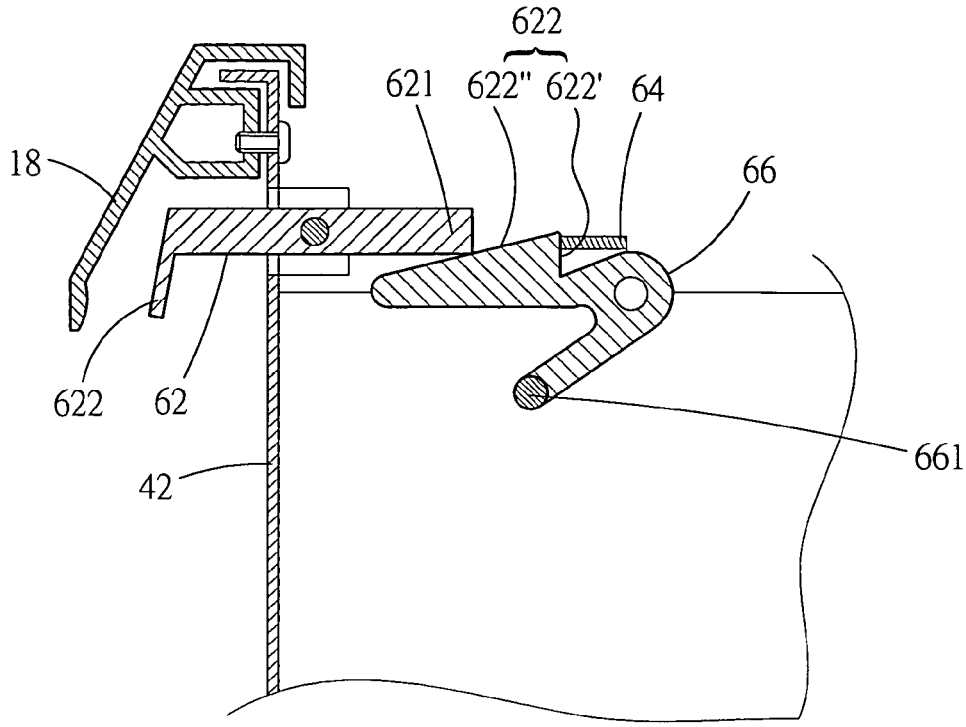
FIGS. 4A and 4B are side views showing the operation of the second embodiment of the present invention.
Figure 4B:
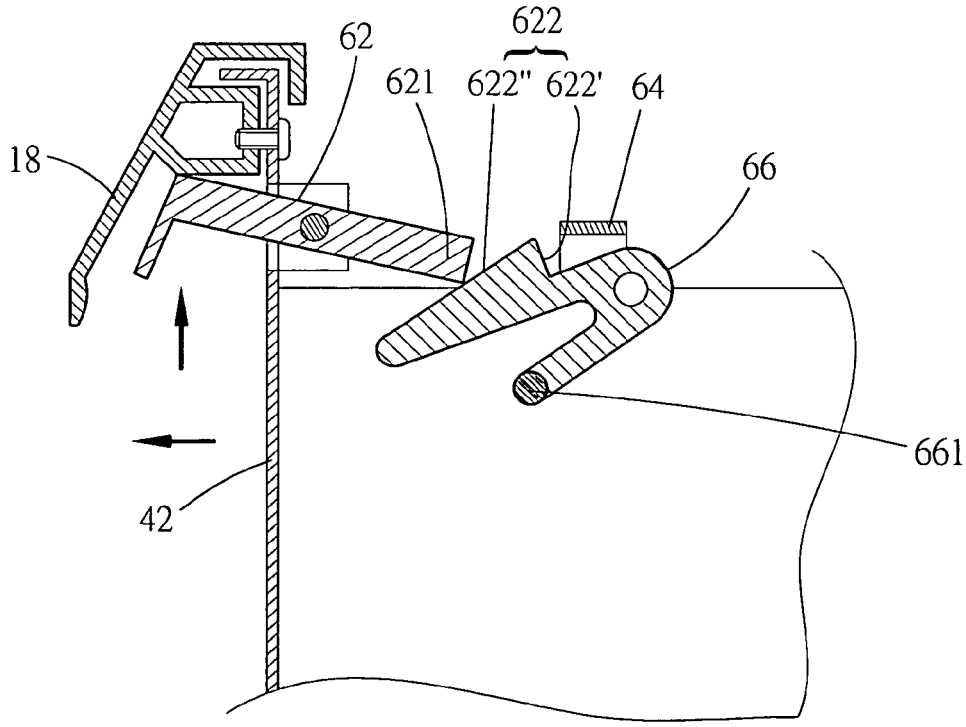

Referring to FIGS. 3, 4A and 4B, a handle 18 is mounted on the front board 42 of the drawer 14 to cover the shift body 62 and achieve a beautified appearance.

Figure 5:
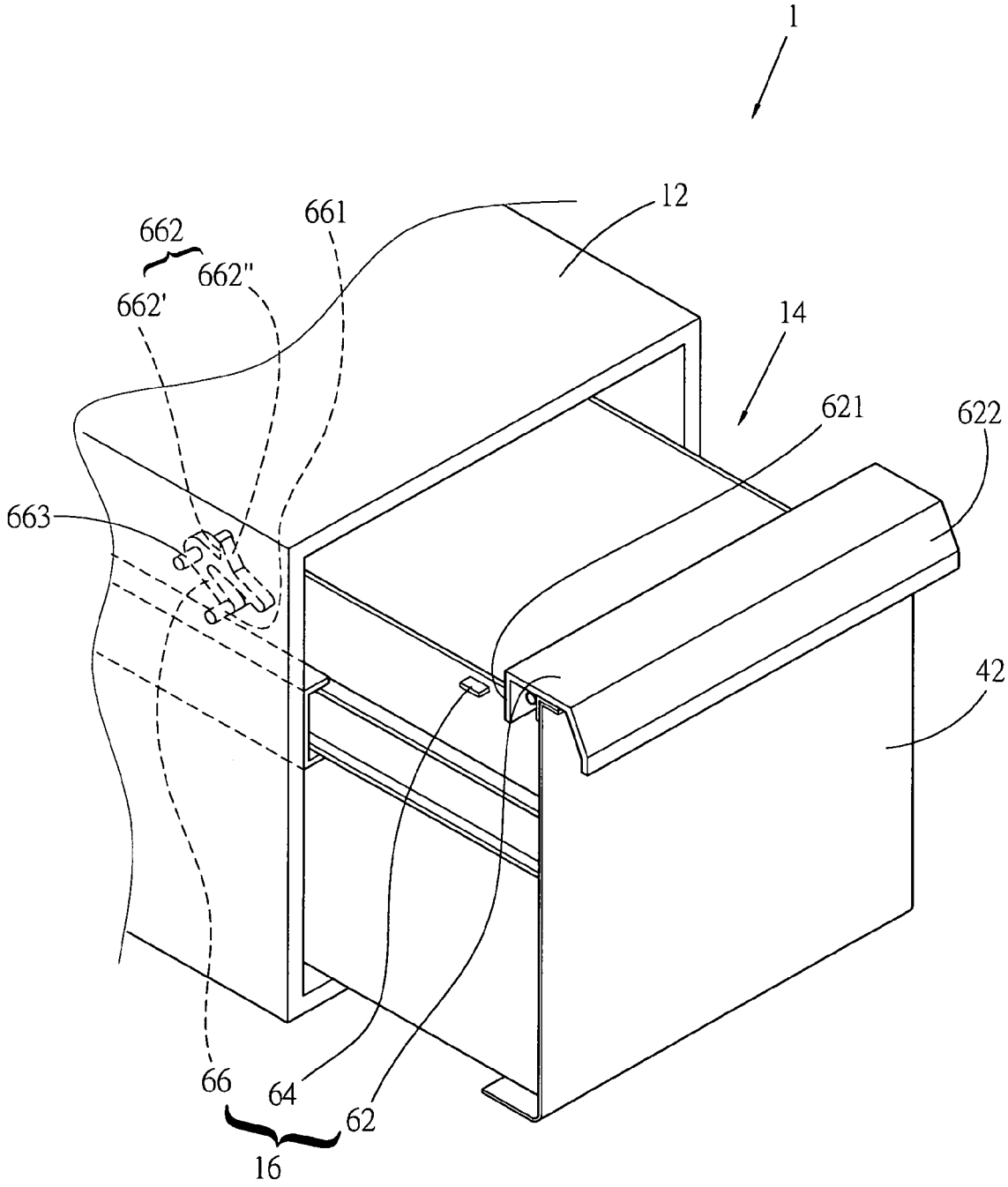
FIG. 5 is a perspective view of a third embodiment of the present invention.

Referring to FIG. 5, the resilient body 66 further includes a second connecting section 663 for connecting with the cabinet body 12 so as to more firmly fix the resilient body 66.

The first and second connecting sections 661, 663 are pivotally connected with the cabinet body to more firmly fix the resilient body 66.

The above embodiments are only used to illustrate the present invention, not intended to limit the scope thereof. Many modifications of the above embodiments can be made without departing from the spirit of the present invention.

What is claimed is:

1. A drawer locking structure comprising:

a) a cabinet body being a rectangular body having a cabinet rear board, two cabinet side boards, an cabinet upper board, a cabinet lower board, and a cabinet front opening;

b) a drawer being a rectangular body having a drawer front board, a drawer rear board, two drawer side boards, a drawer lower board, and an upper opening, the drawer being slidable connected to the cabinet body and movable between a first position within the cabinet front opening and a second position extending outwardly from the cabinet front opening; and c) a lock device movable between locked and unlocked positions and having:

i) a shift body pivotally connected to the drawer front board at a middle portion thereof and having a driving section located on an interior of the upper opening and a force application section located on an exterior of the drawer and protruding outwardly from the drawer front board;

ii) a stopper body located on an exterior of one of the two drawer side boards; and iii) a resilient body having a first connecting section connected to a first of the two cabinet side boards and an engaging section selectively engaging the stopper body, the resilient body having a U-shaped cross-section, wherein, when the lock device is in the locked position, the force application section is pivoted downwardly pivoting the driving section upwardly and releasing the engaging section to resiliently move upwardly, the engaging section engaging the stopper body and locking the drawer in the first position, and, when the lock device is in the unlocked position, the force application section is pivoted upwardly pivoting the driving section downwardly and pressing the engaging section downwardly, the engaging section is separated from the stopper body and the drawer is slidable between the first and the second positions.

2. The drawer locking structure according to claim 1, wherein the engaging section having a stop face and a guiding slope, the stop face selectively engaging the stopper body, the guide slope guiding the stopper body to engage the stop face.

3. The drawer locking structure according to claim 1, wherein the resilient body includes a second connecting section connected to the first of the two cabinet side boards.

4. The drawer locking structure according to claim 2, wherein the resilient body includes a second connecting section connected to the first of the two cabinet side boards.

5. The drawer locking structure according to claim 3, wherein the first connecting section and the second connecting section are pivotally connected to the cabinet body.

6. The drawer locking structure according to claim 4, wherein the first connecting section and the second connecting section are pivotally connected to the cabinet body.

* * * * *